US005201966A

United States Patent [19]

Hirai

[11] Patent Number: 5,201,966

[45] Date of Patent: Apr. 13, 1993

[54] METHOD FOR MAKING CYLINDRICAL, IRON-BASED SINTERED SLUGS OF SPECIFIED POROSITY FOR SUBSEQUENT PLASTIC DEFORMATION PROCESSING

[75] Inventor: Yoshiki Hirai, Tokyo, Japan

[73] Assignee: Hitachi Powdered Metals, Co., Ltd., Tokyo, Japan

[21] Appl. No.: 853,641

[22] Filed: Mar. 18, 1992

Related U.S. Application Data

[62] Division of Ser. No. 573,471, Aug. 24, 1990, Pat. No. 5,129,961.

[30] Foreign Application Priority Data

Aug. 31, 1989 [JP] Japan ..... 64-224920

[51] Int. Cl.[5] ..... B22F 9/00; C22F 1/00

[52] U.S. Cl. ..... 148/514; 148/902; 419/41; 419/67

[58] Field of Search ..... 148/514, 902; 419/41, 419/67

[56] References Cited

U.S. PATENT DOCUMENTS

| | | | |
|---|---|---|---|
| 3,901,661 | 8/1975 | Kondo et al. | 419/11 |
| 4,018,632 | 4/1977 | Schmidt | 148/514 |
| 4,364,162 | 12/1982 | Nilsson et al. | 419/41 |
| 4,867,807 | 9/1989 | Torisaka et al. | 420/902 |

FOREIGN PATENT DOCUMENTS

| | | | |
|---|---|---|---|
| 2016523 | 9/1979 | United Kingdom | 148/514 |

*Primary Examiner*—Upendra Roy
*Attorney, Agent, or Firm*—McGlew and Tuttle

[57] ABSTRACT

A cylindrical, iron-based sintered slug comprising an iron-based sintered alloy having a surface hardness represented by an HRB of 40–90 is formed such that its interior porosity is 5% or less but greater than 0%, the porosities of both its surface layer regions lying at most 1 mm below its outer and inner surfaces are fixed at at least 3% or less but greater than 0% and the distribution of pores in each of the surface layers is decreased gradually toward the surface.

1 Claim, 2 Drawing Sheets

METHOD FOR MAKING CYLINDRICAL, IRON-BASED SINTERED SLUGS OF SPECIFIED POROSITY FOR SUBSEQUENT PLASTIC DEFORMATION PROCESSING

This is a divisional application of application Ser. No. 07/573,471 filed Aug. 24, 1990 now U.S. Pat. No. 5,129,961.

BACKGROUND OF THE INVENTION

1. Field of the Invention

The present invention relates to a cylindrical sintered slug suitable for use as materials for plastic processing, by way of example, cold-extruding iron-based mechanical parts such as gears, and a method for making it.

2. Prior Art

When mechanical parts such as gears are manufactured by plastic deformation processing such as forging and extrusion, the materials or preforms used to this end are referred to as slugs. Most of mechanical parts such as gears are formed of a steel material and generally assume a cylindrical forms. Accordingly, the slugs for plastic deformation processing used to this end are often formed of a steel material in a cylindrical form.

In this connection, cylindrical slugs applied mainly to cold-compression deformation processings have been manufactured by the following techniques.

(1) A rod-like steel material is cut into a columnar shape, which is subsequently flattened, perforated and formed by cold plastic deformation processing. Afterwards, the formed product is subjected to annealing and plastic deformation processing with lubrication such as phosphating.

(2) A columnar member is cored out by hot forging and, subsequently, extruded partially machined or cut and formed. Afterwards, the formed product is annealed and lubricated.

(3) A columnar member is machined or cut.

However, such conventional techniques for making cylindrical slugs as mentioned above leave much to be desired because of their disadvantages of increased number of parts involved and the poor yield of material.

One may predict that sinter forging techniques relying upon powder metallurgy give cylindrical slugs with improved yields of material and great economical efficiency. However, as described in some literature, for instance, the "Sintered Mechanical Parts and their Design/Production", edited by the Japan Association of Powder Metallurgy and published by Gijutu Shoin, cylindrical slugs manufactured by sinter forging present the phenomenon that the amount of pores in their central regions are smaller than that of pores in their surface layers.

It is presumed that this phenomenon is caused by the fact that a larger number of pores remain on the surface of slug, because the result that the surface of slug preform in contact with the tool is cooled at the time of forging makes its plastic flowing difficult.

Accordingly, when such slugs are used for cold- or hot-compression plastic processings, a problem on as compressed arises. That is cracks or breaks are caused on their outer and inner surface because of the friction on their surface contact with each tool surface. For that reason, conventional sinter-forged slugs had to be machined or cut to remove their surface layers for plastic deformation processings use.

In this connection, it is noted that reducing the amount of pores in the sinter-forged slugs surface may be achieved by increasing forging temperature and pressure as well as tool temperature; however, the resulting slugs have a disadvantage of being reduced in their service life of productivity.

The situation being like this, the sinter-forging techniques have not yet been used to obtain slugs for making iron-based mechanical parts such as gears in spite of their improved economical efficiency.

The present invention, in view of the foregoing, seeks to provide a cylindrical, iron-based sintered slug for plastic processing, which has no crack or breaks on its surface and can be processed at lower costs but with higher yields of material.

SUMMARY OF THE INVENTION

As a result of intensive and extensive studies made with a view to achieving the object mentioned above, it has now been found that a slug is plastically well-formed when its surface hardness is in an HRB range of 40 to 90 and its porosity ratio is 5% or less but great than 0% and that the mechanical properties of formed parts made with it by plastically process are improved correspondingly by. It has also been noted that when a cylindrical slug is formed such that, the porosities ratio of both its outer and inner surface, at regions 1 mm below the surface are fixed at at least 3% or lower and the amount of pores is made decrease gradually toward its surfaces, whereby stress due to the friction of the slug with a tool surface at the time of plastic processing is unlikely to concentrate at the pores, preventing substantially any cracking of the surface region of the slug.

BRIEF DESCRIPTION OF THE DRAWINGS

The present invention will now be described in greater detail, by way of example, with reference to the accompanying drawings in which.

DETAILED DESCRIPTION OF THE INVENTION

Figure 1:
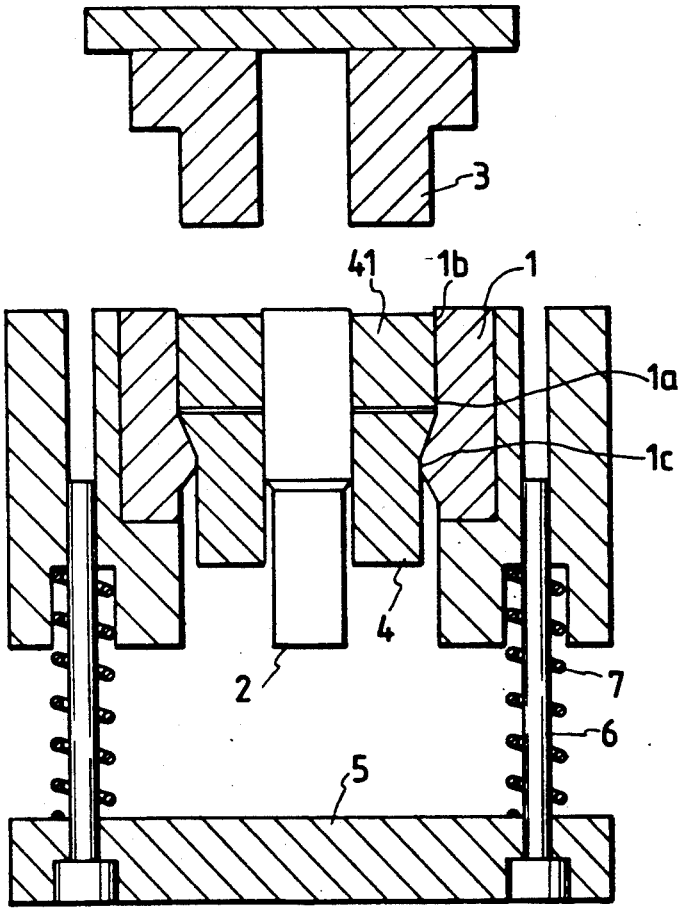
FIG. 1 is a sectional view showing part of an extruder.

The slug, to which the present invention relates, is an alloy comprising an iron-based sintered material. It has a surface hardness fixed at an HRB ranging from 4 to 90, but is not restricted in its chemical composition.

Pure iron intended for, e.g., magnetic material parts and high alloy steels, etc. having an HRB higher than 90 are not the subject of the present invention, because the pure iron pre form has a surface hardness represented by HRB of about than 40 after straightening/annealing, and high alloy steels having a hardness of over HRB 90 are unsuitable as the slug for cold or warm plastic deformation processing. Preferably, the interior porosity of the slug should be fixed at 5% or less but greater than 0%.

The reason for fixing the porosity at 5% or less but greater than 0% is that at a porosity higher than 5%, cracking constantly occurs in the sintered material. It is here to be noted that an inner porosity of 5% corresponds to a density of 7.45 g/cm$^3$, when the real density without porosity of an alloy is 7.85 g/cm$^3$ (i.e. 0% porosity).

As illustrated in, e.g., FIG. 5.23 in the foregoing "Sintered Mechanical Parts and their Design/Production", a sinter-forged material presents at a density higher than 7.45 g/cm$^3$, the phenomenon that the rate of reduction of an area ruptured at the time of tensile testing increases rapidly.

To put it another way, slugs are plastically well-formed at an interior porosity of 5% or less but greater than 0% and the physical properties of formed mechanical parts made with them are improved correspondingly.

However, the present invention excludes a 0% porosity materials so as to draw a distinction between sintered materials and steel materials.

Further, general-purpose slugs may be made by forming a slug material having the porosities of the surface layer regions on its inner and outer surfaces fixed at a reduced value and the amount of pores decreased gradually toward its inner and outer surfaces. With such slugs, it is possible to obtain cylindrical mechanical parts such as gears without any defect on both their inner and outer surfaces.

According to one aspect of the present invention, there is provided a cylindrical, iron-based sintered slug suitable for use as a material for plastic deformation processing, e.g., for obtaining iron-based mechanical parts such as gears by cold extrusion, characterized in that it comprises an iron-based sintered alloy having a surface hardness represented by an HRB of 40 to 90 and is formed such that the porosities of both its surface layer regions lying at most 1 mm below its outer and inner surfaces are fixed at at least 3% or lower and the distribution of pores in each surface layer region is decreased gradually toward the surface.

The iron-based sintered slug of the above structure may be made in conventional manners by compressing or forging an iron-based sintered material heated to, e.g., about 950° C. in a heated mold and slowly cooling the resulting sinter-forged piece from a temperature of about 850° C. As already mentioned, however, this sinter-forged piece presents the phenomenon that, when formed into a slug, the amount of pores in its surface layer region is more than that of pores in its central region. In addition, the sinter-forged piece is such that its surface layer is reduced in porosity over a region of only about 3 to 5 mm in width. Thus, when the sinter-forged piece is formed into a thick, cylindrical slug, the porosity of the central region of the slug remains unchanged as the piece is sinter-forged.

If the rate of reduction of diametrically sectional area of the cylindrical sinter-forged piece, i.e., the rate of reduction of area at right angles with its axis is below 10%, then the porosity of a region lying 1 mm below its surface is short of 3%.

However, a porosity higher than 45% is not desirable, since load for extrusion becomes too high. Thus, the upper limit of porosity is preferably about 30%, although varying depending upon the hardness of sinter-forged pieces.

The extruded slug, which is set mainly on its surface, is heated to a temperature of about 850° C. in a non-oxidizing gas and, then, slowly cooled for straightening (softening) annealing, if required, followed by phosphating and treating with a solid lubricant.

According to another aspect of the present invention, therefore, there is provided a method for making cylindrical iron-based sintered slugs suitable for carrying out the first aspect of the present invention, characterized in that a cylindrical iron-based sinter-forged material is plastically extruded such that its rate of reduction of sectional area in the diametrical direction is at 10%, or higher followed by annealing.

EXAMPLES

More illustratively, the first and second aspects of the present invention will now be explained with reference to the following examples.

Preparation of Sintered Material

A mixture of iron alloy powders, graphite and a molding lubricant was compressed and sintered in the conventional manner to prepare cylindrical sintered pieces of various sizes, which were composed of 1.5% of Ni, 0.5% of Cu, 0.5% of Mo, 0.4% of C and the rest being iron and had a density of 6.7 g/cm$^3$.

Hot Forging and Annealing

Next, the sintered pieces heated to about 950° C. were pressed in a mold heated to 150° C. and, then, slowly cooled from a temperature of 850° C. in an ammonia cracker gas to prepare various sinter-forged samples in cylindrical forms.

While taking the rate of reduction of area by the post-extrusion into account, the samples were dimensioned such that their inner diameters were kept constant at 10 mm with their five outer diameters, say, 32.6 mm, 33.3 mm, 34.2 mm, 36.1 mm and 38.4 mm. The samples were also prepared with target densities, say, of 7.3 g/cm$^3$, 7.5 g/cm$^3$, 7.6 g/cm$^3$ and 7.7 g/cm$^3$.

Extrusion

With such an apparatus as shown in FIG. 1, the cylindrical sinter-forged samples were extruded at normal temperature.

As illustrated, the apparatus or extruder includes a die 1 having an inner bore 1*a*. The front side, as viewed from the direction of extrusion, of the inner bore 1*a* is reduced to an inner diameter at diameter reduced section 1*c* of 32.6 mm, while the other or rear side of the inner bore 1*a* has an aperture enough to allow a sinter-forged sample 4 to be freely fitted into it.

The die 1 is supported by a guide rod 6 extending vertically from a base plate 5, and is upwardly biased by a spring 7.

On the other hand, a mandrel 2 is a rod-like member designed to be freely fitted into a bore 4*a* in the sinter-forged sample 4. That member or mandrel 2 has an elongated portion which is inserted and supported in the inner bore 1*a* in the die 1 through the sinter-forged sample 4 in coaxial relation, and is freely vertically displaceable in the Figure.

A pressure punch 3 is a cylindrical body which is to be freely fitted in between the inner bore 1*a* in the die 1 and the outer surface of the mandrel 2.

As the sinter-forged sample 4 is inserted in the inner bore 1*a* in the die 1 and forced down by the pressure punch 3, it is axially compressed through the diameter-reduced section 1*c*, in which it is reduced in its sectional area and wrapped around the mandrel 2.

At this time, the sinter-forged sample 4 is axially extended relative to the resulting plastic deformation and reduction of sectional area and the mandrel 2 and die 1 are moved in the direction of pressurization into engagement with the base plate 5.

Pressurization is interrupted a little before the sinter-forged sample 4 leaves the diameter-reduced section 1*c* to force down the succeeding sinter-forged sample 41, like this sinter-forged sample 4. Leaving the diameter-reduced section 1c, the sinter-forged sample 4 already let down is then forced cut along the diameter-reduced section of the mandrel 2 to let up the die 1 and mandrel 2, thereby picking up the sinter-forged sample 4.

The thus prepared cylindrical sinter-forged samples (hereinafter simply called the samples) were 10 mm in inner diameter and 32.6 mm in outer diameter with the rate of reduction of area by extrusion being 0%, 5%, 10%, 20% and 30% corresponding to their outer diameters.

Annealing

The extruded samples were each slowly cooled from a temperature of 850° C. in an ammonia cracker gas.

The obtained samples had a surface hardness represented by an HRB of 65 to 70.

Figure 2:
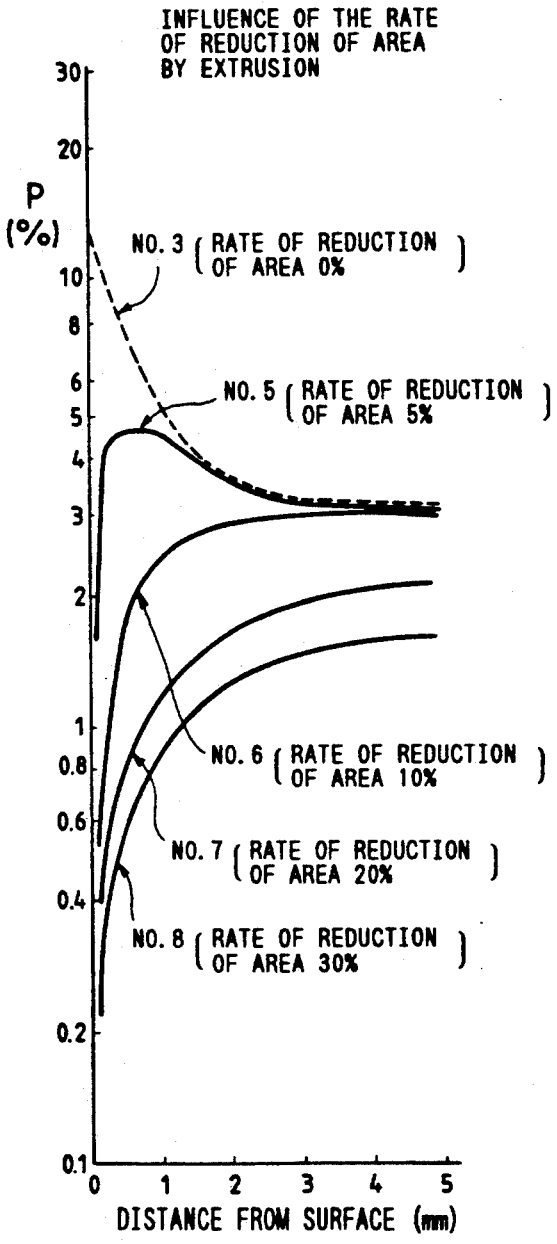
FIGS. 2 and 3 are graphs showing porosity distributions of various slug samples in cross-section.
Figure 3:
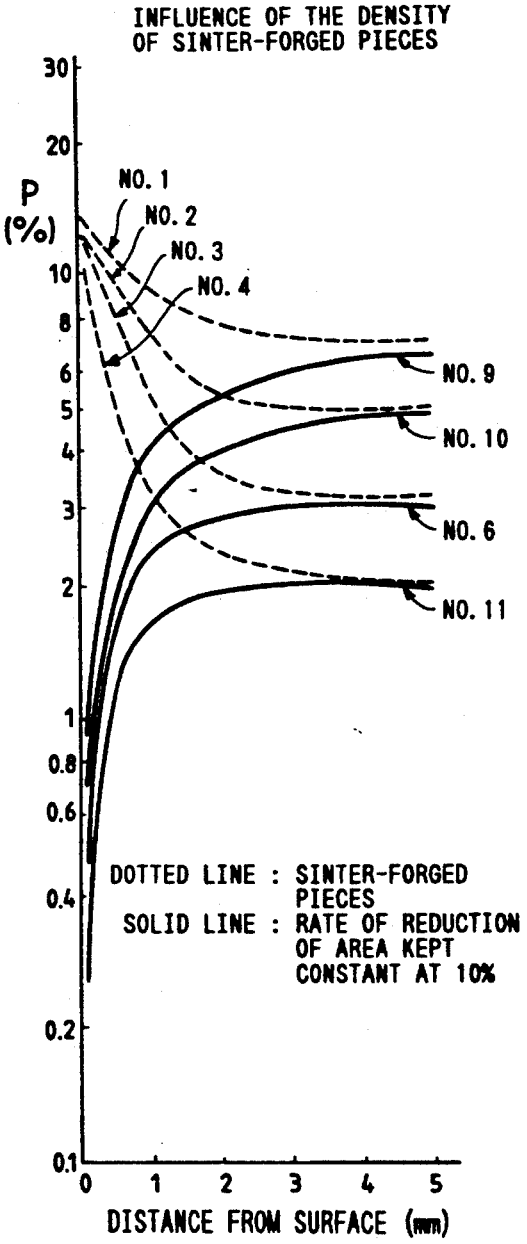

FIGS. 2 and 3 show the amount of pores in each sample, as measured in the section at right angles with its axis.

In order to determine the amount of pores, each sample was polished in section, as carried out in ordinary microscopy, and observed under a microscope to determine a sectional-area porosity per unit area with an image analyzer.

For sectional polishing, each sample was embedded in resin together with porosity standard pieces located adjacent to it, said pieces being formed of 0.4% of C containing iron-based sintered materials (with a true specific gravity of 7.85), one having a density of 7.06 g/cm$^3$ (with a porosity of 10%) and the other a density of 7.46 g/cm$^3$ (with a porosity of 5%), and was then polished to the porosities of the standard pieces.

FIG. 2 illustrates porosity distributions of several samples, each having a forging density of 7.6 g/cm$^3$ and a specific rate of reduction of area, as measured from its surface toward its centeral region.

It is found that in forged sample No. 3 (with the rate of reduction of area being 0%), the amount of pores increases from a depth of about 3 mm below its surface toward its surface.

Sample No. 5 (with the rate of reduction of area by extrusion being 5%) shows the largest amount of pores in a region lying about 0.5 mm below its surface with a porosity distribution in which the amount of pores decreases from its surface toward its centeral region.

In forged sample Nos. 6–8 (with the rate of reduction of area being 10% or more), the amount of pores decreases gradually from their central regions toward their surfaces.

FIG. 3 illustrates sectional-porosity distributions of forged sample Nos. 1–4 (with different densities) and forged sample Nos. 6, 9, 10 and 11 obtained by extruding them at a rate of reduction of area of 10%. The forged samples, shown by dotted lines, all have an increased amount of pores irrespective of their densities.

In the extruded sample Nos. 6, 9, 10 and 11 shown by solid lines, on the other hand, the amount of pores decreases gradually from their central regions toward their surfaces.

Next, the cylindrical samples (slugs) shown in FIGS. 2 and 3 were used to make gears by forward extrusion and the obtained tooth surfaces were examined on whether or not they cracked.

The extruder used were substantially similar in structure to that shown in FIG. 1, except that the diameter-reduced section 1c of the die 1 was provided with a tooth profile and somewhat extended in the direction of processing.

Various dimensions of the external gears were:

Module: 1.5
Pressure Angle: 20°
Number of Teeth: 19
Diameter of Tooth Top: 32.2 mm
Diameter of Tooth Bottom: 25.8 mm
Inner Diameter: 10 mm That is to say, the size of the inner diameter is the same as that of the slugs and both tops and bottoms of the tooth are formed by the cold extrusion of the slugs in which they are axially forced in for plastic flowing.

The testing results are tabulated in Table 1.

It is noted that the tooth surface defect rate is estimated on the basis of at least one crack per 100 samples.

TABLE 1

| Samples No. | Rate of Reduction of Area by Extrusion (%) | Sectional Porosity of Slugs (%) | | Tooth Surface Defect Rate (%) |
|---|---|---|---|---|
| | | Center | 1 mm Deep | |
| 1 | 0 | 7.0 | 9.0 | 100 |
| 2 | 0 | 5.0 | 7.2 | 100 |
| 3 | 0 | 3.2 | 5.3 | 96 |
| 4 | 0 | 2.0 | 3.2 | 90 |
| 5 | 5 | 3.2 | 4.5 | 32 |
| 6 | 10 | 3.0 | 2.4 | 0 |
| 7 | 20 | 2.1 | 1.2 | 0 |
| 8 | 30 | 1.6 | 0.9 | 0 |
| 9 | 10 | 6.6 | 4.1 | 16 |
| 10 | 10 | 4.9 | 3.0 | 0 |
| 11 | 10 | 2.0 | 1.7 | 0 |

Sinter-forged sample Nos. 1–4 cracks more frequently.

Sample Nos. 5–8 are slugs obtained by extruding sample No. 3 at various rates of reduction of area. At a rate of reduction of area of 10% or more, the gears do not develop any defect.

Sample Nos. 6 and 9–11 are obtained by extruding sample Nos. 1–4 at a rate of reduction of area of 10%. Sample No. 10 has a porosity of 4.9% in its central region and a porosity of 3% in a region lying 1 mm below its surface. With the samples having porosities lower than the referred to, no defect is developed whatever.

Similar gears were made by plastically extruding slug materials composed of an iron-based sintered alloy containing 1.5% of Cu and having a surface-hardness-after-annealing represented by an HRB of 45–55 and slugs having an HRB of 86–92, prepared by annealing at an increased cooling rate the same extruded pieces as used in the example. These gears showed a similar tendency as to the occurrence of tooth surface defects.

EFFECT OF THE INVENTION

According to the first aspect of the present invention, there is provided a cylindrical, iron-based sintered slug comprising an iron-based sintered alloy having a surface hardness represented by an HRB of 40–90, which is formed such that its interior porosity is 5% or less but greater than 0%, the porosities of both its surface layer regions lying at most 1 mm below its outer and inner surfaces are fixed at least 3% or less, but greater than 0% and the distribution of pores in each surface layer is decreased gradually toward the surface. When this slug is plastically processed to make mechanical parts, especially, gears, it is unlikely that stress produced by the friction between a mold surface and the slug may concentrate upon pores in the surface layer of the slug, giving rise to cracking of that surface layer. It is thus possible to manufacture mechanical parts in a similar manner as applied with conventional ingot materials but with improved yields of material and at low costs.

According to the second aspect of the present invention, it is possible to mass-produce inexpensively the slug according to the first aspect of the present invention.

Thus, the present invention makes a great contribution to the advancement in material industries.

What is claimed is:

1. A method for forming an iron-based sintered slug, comprising the steps of: providing a porous iron-based sintered alloy material having a surface hardness represented by an HRB of 40–90, the iron-based sintered alloy material being formed with an interior porosity greater than 0% and less than or equal to 5% and with a surface layer region lying at most at 1 millimeter below outer and inner surfaces having a porosity fixed at a porosity greater than 0% and less than or equal to 3%, and providing a distribution of pores decreasing from said interior to said surface region; and plastically extruding said iron-based sintered alloy material by providing a rate of reduction of sectional area in a diametrical direction which is at least 10%; and subsequently annealing the iron-based sintered based material.

* * * * *